US009897952B2

(12) United States Patent
Hasebe et al.

(10) Patent No.: US 9,897,952 B2
(45) **Date of Patent: *Feb. 20, 2018**

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Yoshifumi Hasebe, Shizuoka (JP); Tadao Kamano, Shizuoka (JP); Takashi Ogiwara, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/241,268

(22) Filed: Aug. 19, 2016

(65) Prior Publication Data

US 2017/0082958 A1 Mar. 23, 2017

Related U.S. Application Data

(63) Continuation of application No. 14/858,144, filed on Sep. 18, 2015.

(51) Int. Cl.
*G03G 15/00* (2006.01)
*G03G 15/20* (2006.01)

(52) U.S. Cl.
CPC ..... *G03G 15/2028* (2013.01); *G03G 15/5029* (2013.01); *B65H 2511/152* (2013.01);
(Continued)

(58) Field of Classification Search
CPC ..... G03G 15/5029; G03G 15/6538; G03G 15/6552; G03G 15/6573;
(Continued)

(56) References Cited

U.S. PATENT DOCUMENTS

2006/0257183 A1 11/2006 Ehara et al.
2010/0040385 A1 2/2010 Furuyama
(Continued)

OTHER PUBLICATIONS

Non-Final Office Action for U.S. Appl. No. 14/858,144 dated Mar. 2, 2016.
(Continued)

*Primary Examiner* — Benjamin Schmitt
(74) *Attorney, Agent, or Firm* — Amin, Turocy & Watson LLP

(57) ABSTRACT

An image forming apparatus comprises a paper feeding unit which feeds a sheet-shaped recording medium, an image forming unit which forms a toner image on the recording medium fed from the paper feeding unit, a fixing unit which fixes the toner image formed by the image forming unit on the recording medium, a stacking unit which stacks the recording medium on which the toner image is fixed by the fixing unit, a temperature sensor which detects the surface temperature of the recording mediums stacked on the stacking unit and a control unit which determines, according to the printing information of the recording medium, whether or not to feed a new recording medium from the paper feeding unit when the surface temperature of the recording mediums detected by the temperature sensor is above a threshold temperature.

10 Claims, 12 Drawing Sheets

(52) U.S. Cl.
CPC ..... *G03G 15/6552* (2013.01); *G03G 2215/00421* (2013.01); *G03G 2215/00772* (2013.01); *G03G 2215/00911* (2013.01)

(58) Field of Classification Search
CPC ..... G03G 2215/00421; G03G 2215/00772; G03G 2215/00911; B65H 2511/152; B65H 2515/40; B65H 2553/27
USPC ..... 399/44, 405; 271/3.09, 3.17, 256
See application file for complete search history.

(56) References Cited

U.S. PATENT DOCUMENTS

| | | | |
|---|---|---|---|
| 2011/0008066 | A1 | 1/2011 | Inoue |
| 2011/0170882 | A1 | 7/2011 | Matsumoto |
| 2013/0003134 | A1 | 1/2013 | Hazu et al. |

OTHER PUBLICATIONS

Final Office Action for U.S. Appl. No. 14/858,144 dated Jul. 6, 2016.

IMAGE FORMING APPARATUS

CROSS-REFERENCE TO RELATED APPLICATIONS

This application is a Continuation of application Ser. No. 14/858,144 filed on Sep. 18, 2015, the entire contents of which are incorporated herein by reference.

FIELD

Embodiments described herein relate generally to an image forming apparatus.

BACKGROUND

An image forming apparatus is known which conveys a sheet-shaped recording medium (hereinafter collectively referred to as 'sheet') while forming an image on the sheet. The image forming apparatus comprises an image forming unit for forming a visible image (toner image) with a toner and a fixer for fixing the toner image on a sheet with heat and pressure. The image forming apparatus comprises a paper discharging tray for overlapping and stacking a plurality of sheets on which a toner image is fixed. However, if the temperature or the stack pressure of the plurality of sheets stacked on the paper discharging tray is increased, then the state of the toner is changed, which may result in the poor quality of images.

DETAILED DESCRIPTION

In accordance with an embodiment, an image forming apparatus comprises a paper feeding unit, an image forming unit, a fixing unit, a stacking unit, a temperature sensor and a control unit. The paper feeding unit feeds a sheet-shaped recording medium. The image forming unit forms a toner image on the recording medium fed from the paper feeding unit. The fixing unit fixes the toner image formed by the image forming unit on the recording medium. The stacking unit stacks the recording medium on which the toner image is fixed by the fixing unit. The temperature sensor detects the surface temperature of the recording mediums stacked on the stacking unit. The control unit determines, according to the printing information of the recording medium, whether or not to feed a new recording medium from the paper feeding unit when the surface temperature of the recording mediums detected by the temperature sensor is above a threshold temperature.

An image forming apparatus 100 of the present embodiment is described below with reference to accompanying drawings in which the same parts are denoted by the same reference signs.

Figure 1:
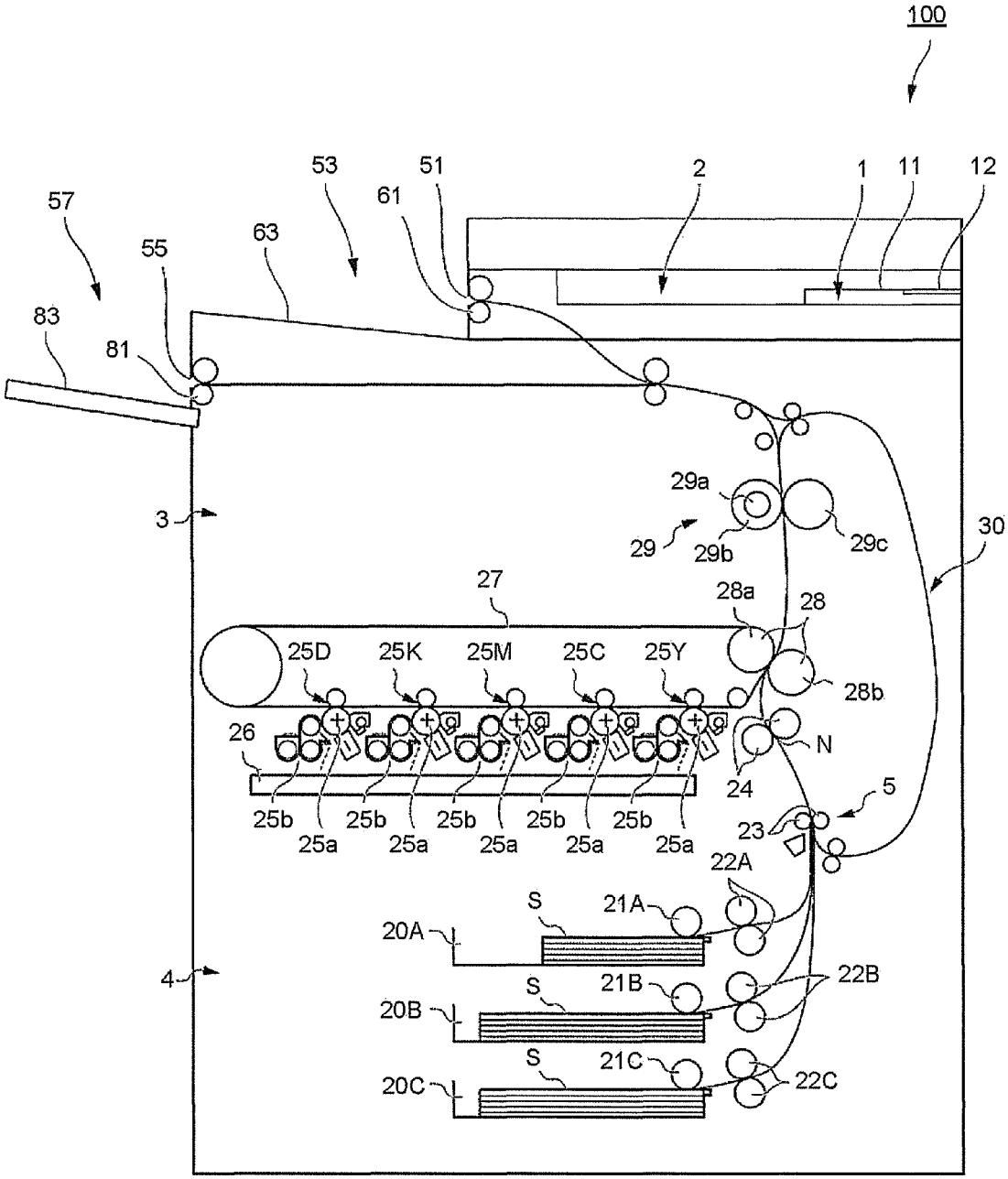
FIG. 1 is a diagram schematically exemplifying the whole structure of an image forming apparatus according to an embodiment.

FIG. 1 is a diagram schematically exemplifying the whole structure of the image forming apparatus 100 according to an embodiment.

As shown in FIG. 1, the image forming apparatus 100 comprises a control panel 1, a scanner unit 2, a printer unit 3, a sheet accommodation unit 4 and a conveyance unit 5.

The image forming apparatus 100 forms an image on the surface of a sheet S with a developing agent such as a toner. The sheet S is a piece of sheet-shaped paper, for example, paper or label paper. The sheet S may be any object as long as an image can be formed on the surface of the sheet S by the image forming apparatus 100.

The control panel 1 comprises a display section 11 and an operation section 12. The display section 11 is a display such as a liquid crystal display or an Electro Luminescence (EL) display. The display section 11 displays various kinds of information related to the image forming apparatus 100. The operation section 12 comprises a plurality of buttons. The operation unit 12 receives the operation of the user on the plurality of buttons. The control panel 1 outputs a signal corresponding to the operation of the user on the operation unit 12 to the under-mentioned control section 101 shown in FIG. 4. Further, the display section 11 and the operation section 12 may be integrated into a touch panel.

The scanner unit 2 reads the image information of a read object as light intensity. The scanner unit 2 generates image data based on the read image information and stores the image data in the memory section 102 shown in FIG. 4 which is described later. The image data generated by the scanner unit 2 can be sent to another information processing apparatus via, for example, a network. The image data generated by the scanner unit 2 can be output to, for example, the printer unit 3.

The print unit 3 forms an image on the surface of the sheet S based on the image data generated by the scanner unit or the image data received from the another information processing apparatus via the network. The printer unit 3 forms an image (hereinafter referred to as toner image) with, for example, a toner. The printer unit 3 transfers the toner image onto the surface of the sheet S. The printer unit 3 heats and presses the toner image on the surface of the sheet S to fix the toner image on the sheet S.

The sheet accommodation unit 4 is a paper feeding unit for feeding a sheet S. The sheet feeding unit 4 feeds sheets S, one by one, to the printer unit 3 matching in time with the formation of a toner image by the printer unit 3. The sheet accommodation unit 4 is provided with a plurality of paper cassettes 20A, 20B and 20C. The paper cassettes 20A, 20B and 20C accommodate sheets S of preset sizes and types, respectively. The paper cassettes 20A, 20B and 20C are provided with pickup rollers 21A, 21B and 21C, respectively. The pickup rollers 21A, 21B and 21C pick up sheets S, one by one, from the paper cassettes 20A, 20B and 20C. The pickup rollers 21A, 21B and 21C convey the sheet S picked up to the conveyance unit 5.

The conveyance unit 5 conveys the sheet S in the printer unit 3 and the sheet accommodation unit 4. The conveyance unit 5 comprises a conveyance roller 23 and a register roller 24. The conveyance unit 5 conveys the sheets S fed from the pickup rollers 21A, 21B and 21C to the register roller 24. The register roller 24 conveys the sheet S according to the time at which the under-mentioned transfer section 28 of the printer unit 3 transfers a toner image onto the surface of the sheet S. The conveyance roller 23 collides the front end of the conveyance direction of sheets S with the nip N of the register roller 24. The conveyance roller 23 adjusts the position of the front end of the sheet S in the conveyance direction by curving the sheet S. After settling the front end of the sheet S conveyed from the conveyance roller 23 in the nip N, the register roller 24 conveys the sheet S to the side of the transfer section 28.

Next, the detailed structure of the printer unit 3 is described below.

The printer unit 3 comprises a plurality of image forming sections 25Y, 25M, 25C, 25K and 25D, an exposure section 26, an intermediate transfer belt 27, a transfer section 28 and a fixing section 29.

The plurality of image forming sections 25Y, 25M, 25C, 25K and 25D form toner images which are transferred onto the sheet S later, respectively. Each of the image forming sections 25Y, 25M, 25C, 25K and 25D comprises a photoconductive drum (image carrier) 25*a*. Each of the image forming sections 25Y, 25M, 25C, 25K and 25D comprises a developer 25*b* for selectively feeding a toner to the surface of each photoconductive drum 25*a*. The developer 25*b* accommodates non-decolorizable yellow, magenta, cyan and black toners and a decolorizable toner. The decolorizable toner is decolorized at a temperature higher than a specific decolorization temperature.

The exposure section 26 is opposite to the photoconductive drums 25*a* of the image forming sections 25Y, 25M, 25C, 25K and 25D. The exposure section 2E irradiates the surface of the photoconductive drum 25*a* of each of the image forming sections 25Y, 25M, 25C, 25K and 25D with laser beams based on image data. Through the irradiation of the laser beam, the exposure section 26 forms an electrostatic latent image on the surface of the photoconductive drum 25*a* of each of the image forming sections 25Y, 25M, 25C, 25K and 25D. Each developer 25*b* develops the electrostatic latent image on the surface of each photoconductive drum 25*a* by feeding a toner to the electrostatic latent image. Each developer 25*b* forms a toner image by sticking a charged toner to the electrostatic latent image on the surface of each photoconductive drum 25*a*. The developer 25*b* of the image forming section 25Y develops the electrostatic latent image on the surface of the photoconductive drum 25*a* with the yellow toner. The developer 25*b* of the image forming section 25M develops the electrostatic latent image on the surface of the photoconductive drum 25*a* with the magenta toner. The developer 25*b* of the image forming section 25C develops the electrostatic latent image on the surface of the photoconductive drum 25*a* with the cyan toner. The developer 25*b* of the image forming section 25K develops the electrostatic latent image on the surface of the photoconductive drum 25*a* with the black toner. The developer 25*b* of the image forming section 25D develops the electrostatic latent image on the surface of the photoconductive drum 25*a* with the decolorizable toner.

Each of the image forming sections 25Y, 25M, 25C, 25K and 25D transfers (primarily transfers) the charged toner image on the surface of each photoconductive drum 25*a* onto the surface of the intermediate transfer belt 27. The image forming sections 25Y, 25M, 25C, 25K and 25D apply a transfer bias to the toner images of the photoconductive drums 25*a* at a primary transfer position, respectively. The image forming sections 25Y, 25M, 25C and 25K overlap the toner images of different colors on the surfaces of the photoconductive drums 25*a* and transfer the overlapped toner images onto the surface of the intermediate transfer belt 27. The image forming sections 25Y, 25M, 25C and 25K overlap the toner images of different colors and transfer the overlapped toner images onto the surface of the intermediate transfer belt 27 to form a color toner image. The image forming section 25D transfers a decolorizable toner image onto the intermediate transfer belt 27.

The transfer section 28 comprises a support roller 28*a* and a secondary transfer roller 28*b* which clamp the intermediate transfer belt 27 and the sheet S from two sides in the thickness direction. The position where the support roller 28*a* is opposite to the transfer roller 28*b* is a secondary transfer position. The transfer section 28 applies a transfer bias corresponding to a transfer current to a secondary transfer position, thereby transferring the toner image on the surface of the intermediate transfer belt 27 onto the surface of the sheet S.

The fixing section 29 comprises a heat roller 29*b* equipped with an internal heating portion 29*a* and a press roller 29*c*. The press roller 29*c* is contacted with the heat roller 29*b* heated by the heating portion 29*a* under a pressurized state. The press roller 29*c* and the heat roller 29*b* convey the sheet S while clamping the sheet S from two sides of the thickness direction of the sheet S. The press roller 29*c* and the heat roller 29*b* fix the toner image on the surface of the sheet S on the sheet S by applying heat and pressure to the sheet S.

The printer unit 3 comprises a reversing unit 30. The reversing unit 30 reverses the sheet discharged from the fixing section 29 through a switchback route. The reversing unit 30 conveys the reversed sheet S to the front of the register roller 24 again. The reversing unit 30 reverses the sheet S so as to form an image on the back of the sheet S subjected to the fixation processing.

Figure 2:
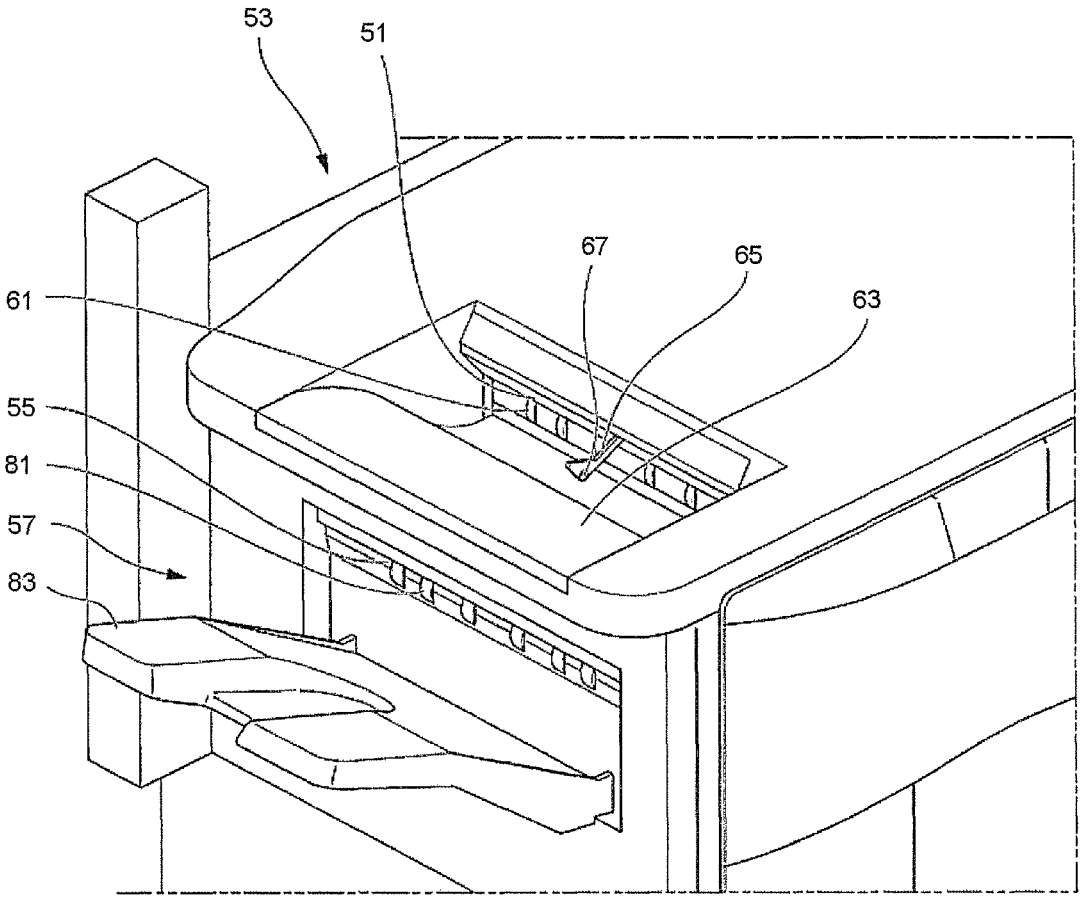
FIG. 2 is an oblique view of an upper paper discharging tray of an image forming apparatus according to an embodiment.
Figure 3:
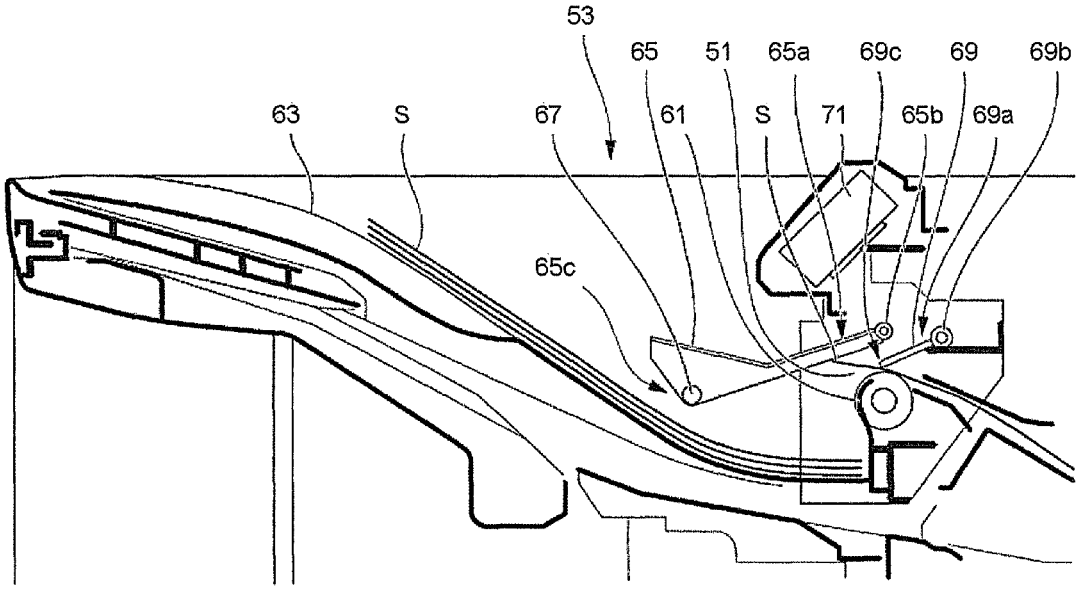
FIG. 3 is a sectional view of an upper paper discharging unit of an image forming apparatus according to an embodiment.

FIG. 2 is an oblique view of an upper paper discharging tray of an image forming apparatus observed from above according to an embodiment. FIG. 3 is a sectional view of an upper paper discharging unit of an image forming apparatus according to an embodiment.

As shown in FIG. 2 and FIG. 3, the image forming apparatus 100 comprises an upper paper discharging section having an upper paper discharging opening 51 and a lower paper discharging section 57 having a lower paper discharging opening 55.

The upper paper discharging section 53 is a stacking section for stacking sheets S. The upper paper discharging section 53 comprises an upper paper discharging roller 61 and an upper paper discharging tray 63. The upper paper discharging roller 61 conveys a sheet S to the upper paper discharging opening 51. The upper paper discharging tray stacks the sheet S discharged from the upper paper discharging opening 51.

The upper paper discharging section 53 comprises a stacked sheet number sensor actuator 65, a discharged paper surface temperature sensor 67, a paper discharging sensor actuator 69 and a discharged paper cooling fan 71. The stacked sheet number sensor actuator 65 is formed into the shape of a level which is inclined downward and protruded with respect to the direction from which a sheet S is discharged from the upper paper discharging opening 51. A first end 65*a* of the stacked sheet number sensor actuator 65 is rotationally supported by a rotation shaft 65*b*. The first end 65*a* is formed into a level shape. A stacked sheet number sensor 66 is a transmissive photoelectric sensor. The transmissive photoelectric sensor comprises a light emitting unit and a light receiving unit. If the stacked sheet number sensor actuator 65 rotates around the axis of the rotation shaft 65*b*, then the first end 65*a* shields the light between the light emitting unit and the light receiving unit of the stacked sheet number sensor 66. The stacked sheet number sensor 66 switches between 'output on' and 'output off' by shielding the light between the light emitting unit and the light receiving unit. The stacked sheet number sensor actuator 65 is limited to rotate within a specific range. The lowest position of a second end 65*c* is located above the upper paper discharging tray 63 and spaced from the upper paper discharging tray 63 by a specific distance. The specific distance refers to the thickness of the most sheets S assumed to be allowed to be stacked with toner images not stuck under specific conditions that are most conductive to the sticking of toner images. The specific conditions refer to an assumed maximum temperature, an assumed maximum print density, double-side printing and the type of the sheet that is most likely to be stuck. The second end 65*c* is located at the lowest position for the sake of the dead weight of the stacked sheet number sensor actuator 65 when the stacked sheet number sensor actuator 65 is not contacted with a sheet S. The second end 65*c* is contacted with the top sheet S in the upper paper discharging tray 63 when the whole thickness of the sheets stacked in the upper paper discharging tray 63 is beyond a specific distance. If the second end 65*c* is lifted up by the top sheet S in the upper paper discharging tray 63, then the stacked sheet number sensor actuator 65 rotates upwards around the axis of the rotation shaft 65*b*. The stacked sheet number sensor actuator 65 is intersected with the direction in which a sheet S is discharged from the upper paper discharging opening 51 and is inclined downwards. If the stacked sheet number sensor actuator 65 collides with the sheet S from the upper paper discharging opening 51, then the stacked sheet number sensor actuator 65 rotates towards the direction in which the second end 65*c* is lifted up.

The discharged paper surface temperature sensor 67 is, for example, a thermistor. The discharged paper surface temperature sensor 67 is arranged on the second end 65*c* of the stacked sheet number sensor actuator 65. When contacted with the top sheet S in the upper paper discharging tray 63, the discharged paper surface temperature sensor 67 detects the surface temperature of the sheet S. When not contacted with a sheet S, the discharged paper surface temperature sensor 67 detects atmosphere temperature.

The paper discharging sensor actuator 69 is formed into a level shape. The paper discharging sensor actuator 69 is configured to block the conveyance path of sheets S. A first end 69*a* of the paper discharging sensor actuator 69 is rotationally supported by the rotation shaft 69*b*. A paper discharging sensor 70 is a transmissive photoelectric sensor. The paper discharging sensor 70 switches between 'output on' and 'output off' through the shielding of the light of the paper discharging sensor 70 by the first end 69*a* according to the rotation of the paper discharging sensor actuator 69 around the rotation shaft 69*b*. When not contacted with a sheet S, the second end 69*c* of the paper discharging sensor actuator 69 is intersected with the conveyance path of sheets S and inclined downwards. If a sheet S being conveyed collides with the paper discharging sensor actuator 69, then the second end 69*c* is pressed upwards and rotated around the rotation shaft 69*b*. If the second end 69*c* of the paper discharging sensor actuator 69 is pressed upwards, then the output of the paper discharging sensor 70 is 'ON'. After the sheet S passes, the second end 69*c* is rotated downwards for the sake of the dead weight of the paper discharging sensor actuator 69.

The discharged paper cooling fan 71 is arranged above the upper paper discharging opening 51 to cool the sheet S discharged from the upper paper discharging opening 51 with the wind supplied from the outside.

The lower paper discharging section 57 comprises a lower paper discharging roller 81 and a lower paper discharging tray 83. The lower paper discharging roller 81 conveys the sheet S to the lower paper discharging opening 55. The lower paper discharging tray 83 stacks sheets S discharged from the lower paper discharging opening 55.

Figure 4:
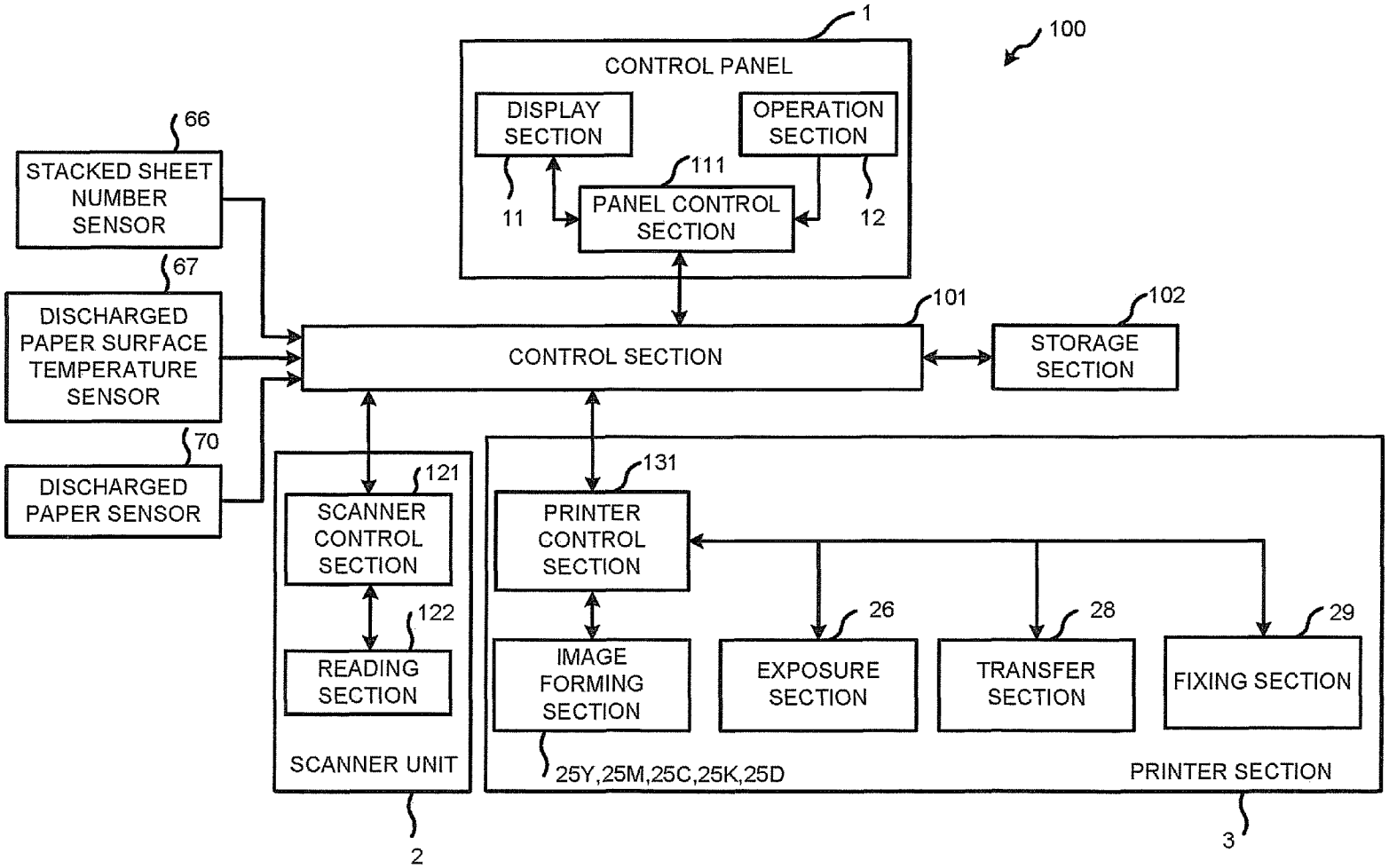
FIG. 4 is a block diagram exemplifying the functional structure of an image forming apparatus according to an embodiment.

The functional structure of the image forming apparatus 100 is described below with reference to FIG. 4 which is a block diagram exemplifying the functional structure of the image forming apparatus 100.

The control panel 1, the scanner unit 2 and the printer unit 3 are connected with the control section 101. The control section 101 uniformly controls the whole action of the image forming apparatus 100. The control section 101 controls the CPU of each of the control panel 1, the scanner unit 2 and the printer unit 3. The control section 101 comprises a CPU, a ROM and a RAM. The ROM stores a control program for controlling the whole action of the image forming apparatus 100. The RAM temporarily stores the various data that are used by the CPU to carry out various processing. The control section 101 is connected with the memory section 102, the stacked sheet number sensor 66, the discharged paper surface temperature sensor 67 and the paper discharging sensor 70. Particularly, the ROM stores the various thresholds that are used by the CPU to carry out various determination processing.

The memory section 102 stores the image data generated by the scanner unit 2 or the image data received from the another information processing apparatus via the network. The memory section 102 is, for example, a hard disk, a semiconductor memory or the like The control panel 1 comprises a display section 11, an operation section 12 and a panel control section 111. The panel control section 111 controls the actions of the display section 11 and the operation section 12. The panel control section 111 comprises a CPU, a ROM and a RAM. The ROM stores a control program for controlling the actions of the display section 11 and the operation section 12. The RAM temporarily stores the various data that are used by the CPU to carry out various processing.

The display section 11 displays various kinds of information that are related to the actions of the image forming apparatus 100 and specified by the user. The display section 11 displays the information input by the user through operating the operation section 12. The operation section 12 accepts the operation of the user, for example, for the input of information related to the processing separately implemented by the scanner unit 2 and the printer unit 3. The information related to the processing implemented by the scanner unit 2 is, for example, a resolution, a compression ratio and color information. The information related to the processing implemented by the printer unit 3 is, for example, the number of the sheets S to be printed, a print condition, the size of a sheet S and the type of a sheet S. The print condition is, for example, the specification on black-and-white printing or color printing, the specification on single-side printing or double-side printing, the specification on print density and the orientation of a sheet S in a conveyance direction. The operation section outputs the various kinds of information specified by the user to the panel control section 111. The panel control section 111 outputs the information from the operation section 12 to the control section 101. The control section 101 outputs the information from the panel control section 111 to the scanner unit 2 or the printer unit 3.

The scanner unit 2 comprises a scanner control section 121. The scanner control section 121 controls the reading of image information by a reading section 122. The scanner control section 121 comprises a CPU, a ROM and a RAM. The ROM stores a control program for controlling the action of the reading section 122. The RAM temporarily stores the various data that are used by the CPU to carry out various processing. The reading section 122 reads the image information of a read object as light intensity and generates image data according to the image information. The printer unit 3 comprises a printer control section 131. The printer control section 131 controls the printing of an image on the sheet S by the printer unit 3. The printer control section 131 comprises a CPU, a ROM and a RAM. The ROM stores control programs for controlling the actions of the plurality of image forming sections 25Y, 25M, 25C, 25K and 25D, the exposure section 26, the transfer section 28 and the fixing section 29. The RAM temporarily stores the various data that are used by the CPU to carry out various processing.

The flow of a print processing carried out by the image forming apparatus 100 is described below with reference to FIG. 5 and FIG. 6.

Figure 5:
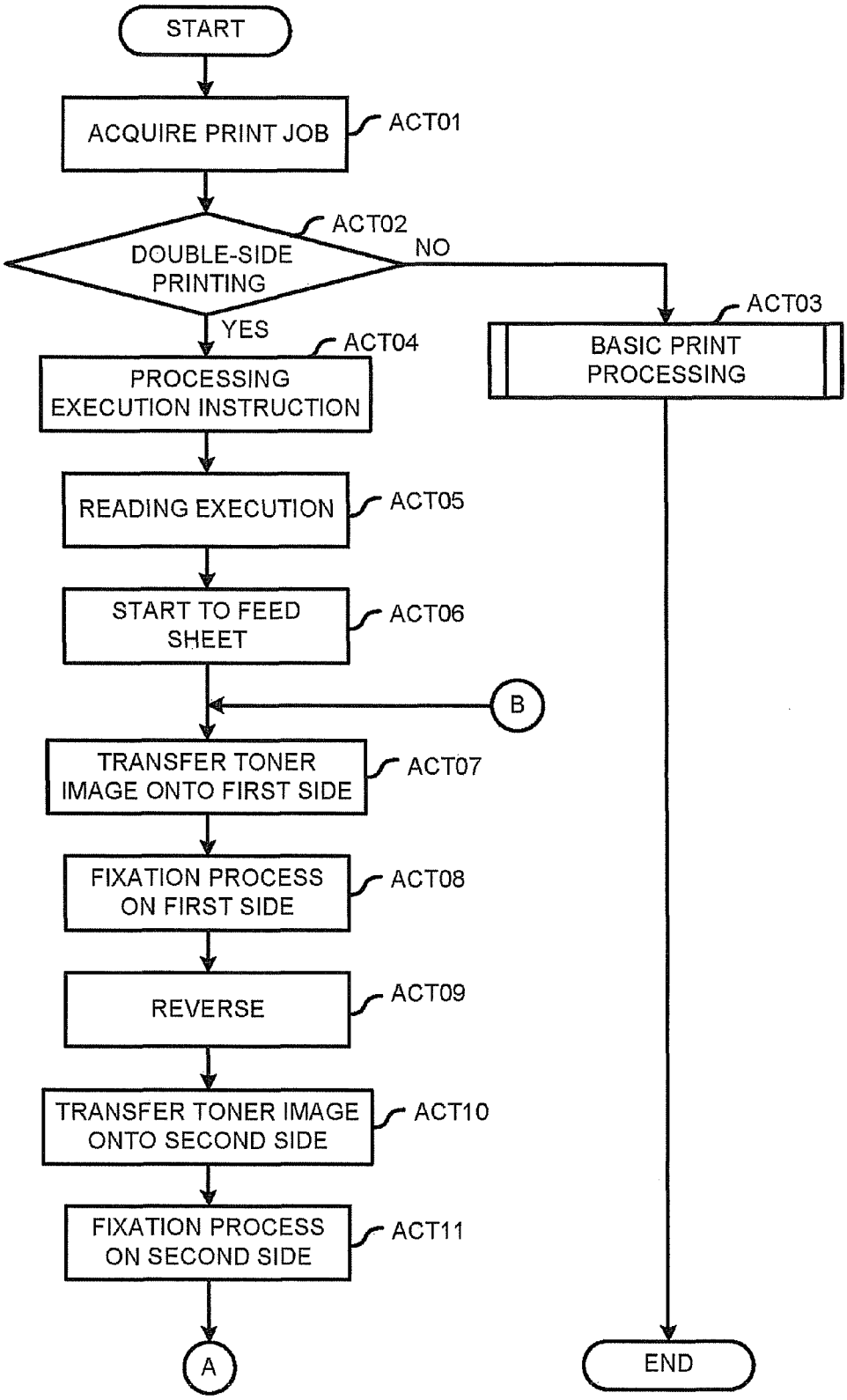
FIG. 5 is a flowchart illustrating the flow of a print processing carried out by an image forming apparatus according to an embodiment.
Figure 6:
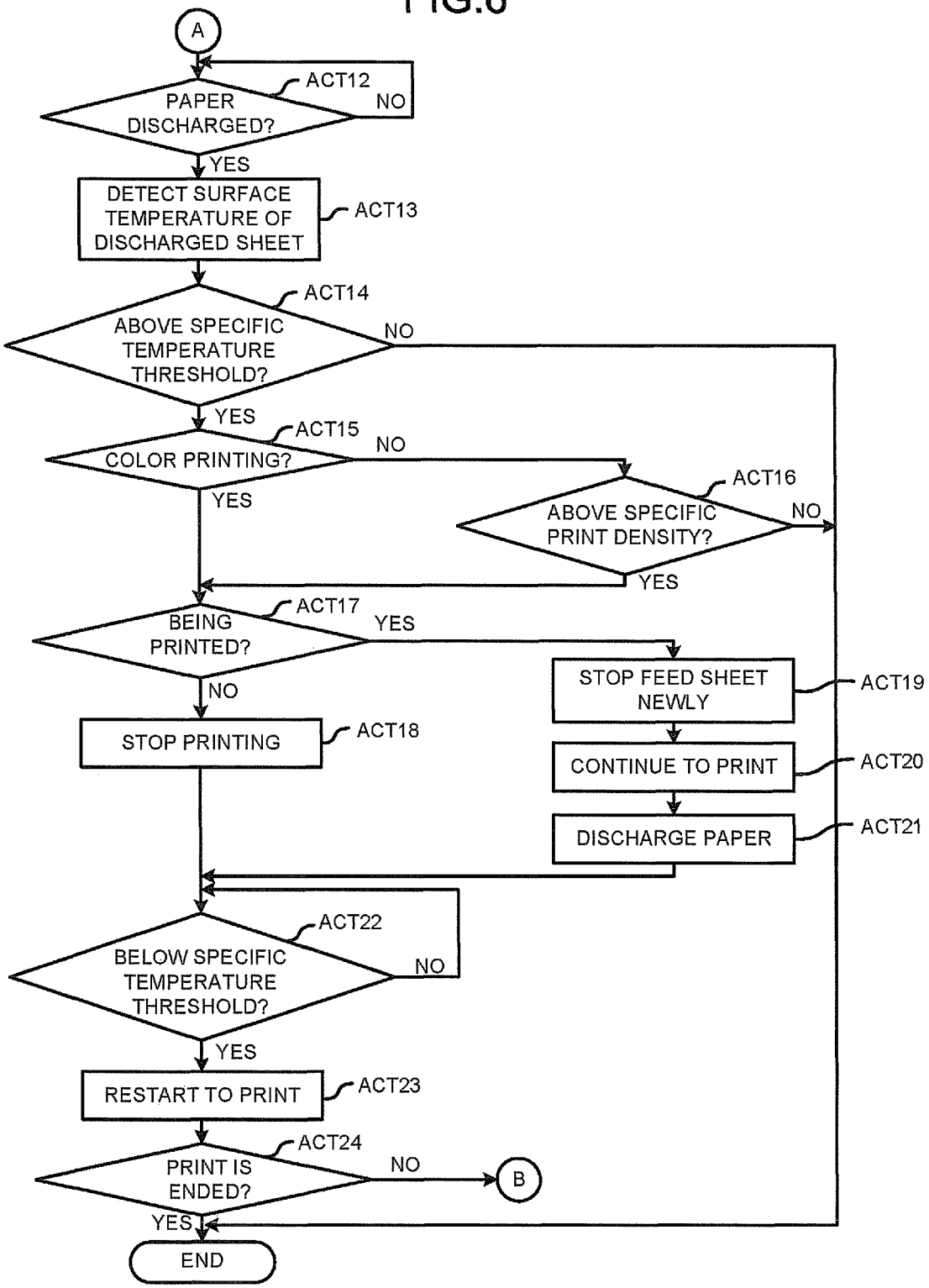
FIG. 6 is a flowchart illustrating the flow of a print processing carried out by an image forming apparatus according to an embodiment.

FIG. 5 and FIG. 6 are flowcharts illustrating a print processing carried out by the image forming apparatus 100 according to an embodiment.

First, the user inputs information indicating the execution of a print processing from the operation section 12 of the control panel 1. The panel control section 111 accepts the processing represented by the information input from the operation section 12 as a print job. The control section 101 writes the print job into an internal RAM while acquiring the print job from the panel control section 111 (Act 01). The print job includes information related to the processing separately carried out by the scanner unit 2 and the printer unit 3.

Next, the control section 101 reads information on a print condition for the print job from the internal RAM and determines whether or not the information on the print condition includes the specification on double-side printing (Act 02).

If the result of the determination is 'No' (Act 02: No), the control section 101 makes the flow proceed to Act 03.

On the other hand, if the result of the determination is 'Yes' (Act 02: Yes), the control section 101 makes the flow proceed to Act 04.

Then, the control section 101 executes a basic print processing (Act 03). The basic print processing refers to other print processing, excluding a double-side printing processing, implemented on a sheet S.

Sequentially, the control section 101 separately instructs the scanner control section 121 and the printer control section 131 to implement a processing corresponding to the print job (Act 04). The control section 101 outputs information related to the processing separately carried out by the scanner control section 121 and the printer control section 131. The information output to the scanner unit 2 is, for example, a resolution, a compression ratio and color information. The information output to the printer control section 131 is, for example, the number of the sheets S to be printed, a print condition, the size of a sheet S and the type of a sheet S. The print condition includes: the specification on double-side printing, the specification on print density, the orientation of a sheet S in a conveyance direction and other information. The scanner control section 121 and the printer control section 131 separately write the information output from the control section 101 into the internal RAM.

The scanner control section 121 reads the information related to the processing instructed to be implemented by the control section 101 into the internal RAM. The scanner control section 121 causes the reading section 122 to read the image information of a read object according to the information acquired from the RAM. The reading section 122 reads a plurality of pieces of image information based on the information related to double-side printing included in the print job. The reading section 122 reads, for example, the image information on two sides of the read object or the image information of a plurality of read objects. The information related to double-side printing is information specifying which side of the sheet S is to be printed with the image information of the read object. The scanner control section 121 acquires the image data generated by the reading section 122 based on the image information (Act 05). The scanner control section 121 outputs the image data to the control section 101. The control section 101 associates the image data from the scanner control section 121 with the first side and the second side of the sheet S based on the information related to double-side printing included in the print job. The control section 101 distinguishes the image data to be printed on the one of the two sides of the sheet S which is printed first (a first side) from that to be printed on a second side, that is, the back side of the first side, and stores the distinguished image data in the memory section 102. The control section 101 outputs the image data to be printed on the first side and the image data to be printed on the second side during a double-side printing process to the printer control section 131. The printer control section 131 writes the image data to be printed on the first side and the image data to be printed on the second side received from the control section 101 into the internal RAM.

Sequentially, the control section 101 instructs the sheet accommodation unit 4 and the conveyance unit 5 to start the conveyance of a sheet S to the printer unit 3 (Act 06). The control section 101 specifies one of the paper cassettes 20A, 20B and 20C based on the sheet size and the sheet type information included in the print job. The sheet accommodation unit 4 picks up sheets S one by one from the specified one of the paper cassettes 20A, 20B and 20C according to an instruction from the control section 101 and feeds the sheets S to the conveyance unit 5. The conveyance unit 5 conveys the sheet S from the sheet accommodation unit 4 to the transfer section 28 matching in time with the transfer of the toner image on the intermediate transfer belt 27 to the sheet S by the transfer section 28.

Then, the printer control section 131 instructs the plurality of image forming sections 25Y, 25M, 25C, 25K and 25D, the exposure section 26 and the transfer section 28 to implement the action on the first side (Act 07). First, the exposure section 26 reads the image data corresponding to the first side from the RAM and forms an electrostatic latent image on the surface of the photoconductive drum 25*a* with the image data corresponding to the first side. Then, at least one of the image forming sections 25Y, 25M, 25C, 25K and 25D develops the electrostatic latent image on the photoconductive drum 25*a* with a toner to form a toner image. Sequentially, at least one of the image forming sections 25Y, 25M, 25C, 25K and 25D transfers the toner image on the photoconductive drum 25*a* onto the surface of the intermediate transfer belt 27. Afterwards, the transfer section 28 transfers the toner image on the surface of the intermediate transfer belt 27 onto the sheet S conveyed from the conveyance section 5.

Then, the printer control section 131 instructs the fixing section 29 to perform a fixation processing on the first side of the sheet S (Act 08). The press roller 29*c* is contacted with the heat roller 29*b* heated by the heating portion 29*a* under a pressurized state, thereby forming a nip. The press roller 29*c* rotates to drive the heat roller 29*b* to rotate. The press roller 29*c* and the heat roller 29*b* fix the toner image by heating and pressurizing the sheet S from the transfer section 28 in the nip.

Then, the printer control section 131 instructs the reversing section 30 to reverse and convey the sheet S (Act 09). The reversing unit 30 reverses the sheet S discharged from the fixing section 29 and conveys the reversed sheet S to the front of the register roller 24 again.

Next, the printer control section 131 instructs the plurality of image forming sections 25Y, 25M, 25C, 25K and 25D, the exposure section 26 and the transfer section 28 to implement the action on the second side (Act 10). First, the exposure section 26 reads the image data corresponding to the second side from the RAM and forms an electrostatic latent image on the surface of the photoconductive drum 25*a* with the image data corresponding to the second side. Then, at least one of the image forming sections 25Y, 25M, 25C, 25K and 25D develops the electrostatic latent image on the photoconductive drum 25*a* with a toner to form a toner image. Sequentially, at least one of the image forming sections 25Y, 25M, 25C, 25K and 25D transfers the electrostatic latent image on the photoconductive drum 25*a* onto the surface of the intermediate transfer belt 27. Afterwards, the transfer section 28 transfers the toner image on the surface of the intermediate transfer belt 27 onto the sheet S conveyed from the conveyance section 5.

Then, the printer control section 131 instructs the fixing section 29 to perform a fixation processing on the second side of the sheet S (Act 11). The press roller 29*c* is contacted with the heat roller 29*b* heated by the heating portion 29*a* under a pressurized state, thereby forming a nip. The press roller 46 rotates to drive the heat roller 29*b* to rotate. The press roller 29*c* and the heat roller 29*b* fix the toner image by heating and pressurizing the sheet S from the transfer section 28 in the nip. The printer control section 131 counts, based on the increment of a counter, the number of the accumulated sheets the first side and the second side of which are subjected to the fixation processing. The printer control section 131 writes the count value of the counter into the internal RAM.

Sequentially, the control section 101 acquires an 'on' or 'off' signal output from the paper discharging sensor 70. The control section 101 writes the signal received from the paper discharging sensor 70 into the internal RAM. The control section 101 determines whether or not the signal from the paper discharging sensor 70 is an 'on' signal representing the contact of a sheet S with the paper discharging sensor actuator 69 (Act 12).

If the result of the determination is 'No' (Act 12: No), the control section 101 implements the determination processing of Act 12 repeatedly.

On the other hand, if the result of the determination is 'Yes' (Act 12: Yes), the control section 101 makes the flow proceed to Act 13.

Next, the control section 101 acquires the temperature detected by the discharged paper surface temperature sensor 67 at this moment. The control section 101 writes the temperature information acquired by the discharged paper surface temperature sensor 67 into the internal RAM. When contacted with the top sheet S stacked in the upper paper discharging tray 63, the discharged paper surface temperature sensor 67 detects the surface temperature of the sheet S. When not contacted with a sheet S, the discharged paper surface temperature sensor 67 detects atmosphere temperature (Act 13).

Then, the control section 101 acquires, from the internal ROM, a specific temperature threshold corresponding to the temperature detected by the discharged paper surface temperature sensor 67. The internal ROM of the control section 101 stores the specific temperature threshold corresponding to the temperature detected by the discharged paper surface temperature sensor 67. The specific temperature threshold is a minimal temperature threshold at which the sheet S stacked in the upper paper discharging tray 63 is assumed to suffer the sticking of toner images. The specific temperature threshold for estimating the temperature difference between the surface temperature of the top sheet S and stacked overlapped sheets has a specific surplus. The specific temperature threshold is surplus for continuing the printing of the sheet S being printed and stacking the sheet S being printed in the upper paper discharging tray 63 even if a new print operation is determined to be stopped. The specific temperature threshold is, for example, 60 degrees centigrade. The control section 101 determines whether or not the temperature detected by the discharged paper surface temperature sensor 67 is above the specific temperature threshold (Act 14).

If the result of the determination is 'No' (Act 14: No), the control section 101 makes the flow proceed to Act 24.

On the other hand, if the result of the determination is 'Yes' (Act 14: Yes), the control section 101 makes the flow proceed to Act 15.

Then, the control section 101 reads information on a print condition for the print job from the internal RAM and determines whether or not the information on the print condition includes the specification on color printing (Act 15). The information specifying color printing included in the print condition is printing information of the sheet S which is used to determine whether or not to feed a sheet S from the sheet accommodation unit 4 newly. If the result of the determination is 'No' (Act 15: No), the control section 101 makes the flow proceed to Act 16.

On the other hand, if the result of the determination is 'Yes' (Act 15: Yes), the control section 101 makes the flow proceed to Act 17.

Then, the control section 101 acquires specific print density information from the internal ROM, wherein the specific print density information is a threshold corresponding to the print density information included in the print condition for the print job. The internal ROM of the control section 101 stores a specific print, density corresponding to the print density included in the print condition. The specific print density is a minimal print density at which the sheet S stacked in the upper paper discharging tray 63 suffers the sticking of toner images. The control section 101 determines whether or not the print density included in the print condition for the print job is above the specific print density (Act 16). The print density information included in the print condition is printing information of the sheet S which is used to determine whether or not to feed a sheet from the sheet accommodation unit 4 newly.

If the result of the determination is 'No' (Act 16: No), the control section 101 ends the processing and stops the printer unit 3.

On the other hand, if the result of the determination is 'Yes' (Act 16: Yes), the control section 101 makes the flow proceed to Act 17.

Then, the control section 101 determines whether or not a print job is being implemented, whether or not a print job is being implemented means that whether or not one of an image formation operation, a transfer operation, a fixation operation and a paper feed operation is being implemented (Act 17).

If the result of the determination is 'No' (Act 17: No), the control section 101 makes the flow proceed to Act 18.

On the other hand, if the result of the determination is 'Yes' (Act 17: Yes), the control section 101 makes the flow proceed to Act 19.

Then, the control section 101 stops the feed of a new sheet S from the sheet accommodation unit 4 to the printer unit 3 and the new print operation of the printer unit 3 (Act 18).

Sequentially, the control section 101 stops the feed of a new sheet S from the sheet accommodation unit 4 to the printer unit 3 (Act 19).

Then, the control section 101 instructs the printer control section 131 to continue to print on the sheet S which is already fed from the sheet accommodation unit 4 to the printer unit 3 (Act 20). The printer control section 131 continues to perform an image formation processing, a transfer processing, a fixation processing and other processing on the sheet S according to an instruction from the control section 101.

Next, the control section 101 discharges the printed sheet S discharged from the fixing section 29 to the upper paper discharging tray 63 through the upper paper discharging roller 61 (Act 21).

Afterwards, the control section 101 acquires the temperature detected by the discharged paper surface temperature sensor 67 at this moment. The control section 101 writes the temperature information acquired by the discharged paper surface temperature sensor 67 into the internal RAM. The control section 101 acquires, from the internal ROM, the specific temperature threshold with respect to the temperature detected by the discharged paper surface temperature sensor 67. The control section 101 determines whether or not the temperature detected by the discharged paper surface temperature sensor 67 is below the specific temperature threshold (Act 22).

If the result of the determination is 'No' (Act 22: No), the control section 101 repeats the determination processing of Act 22.

On the other hand, if the result of the determination is 'Yes' (Act 22: Yes), the control section 101 makes the flow proceed to Act 23.

Then, the control section 101 instructs the sheet accommodation unit 4 to feed a new sheet S to the printer unit 3 and the printer unit 3 to start a new print operation again (Act 23).

Next, the printer control section 131 reads 'number of copies' of sheets S from the internal RAM and the count value of the counter. The printer control section 131 determines whether or not the count value of the counter written in the internal RAM in Act 11 reaches the 'number of copies' (Act 24).

If the result of the determination is 'No' (Act 24: No), the printer control section 131 makes the flow return to Act 07.

On the other hand, if the result of the determination is 'Yes' (Act 24: Yes), the printer control section 131 ends the processing and stops the printer unit 3.

The actions carried out by the image forming apparatus 100 in a case where a small number of sheets S are stacked in the upper paper discharging tray 63 and the discharged paper surface temperature sensor 67 is not contacted with a sheet S.

Figure 7:
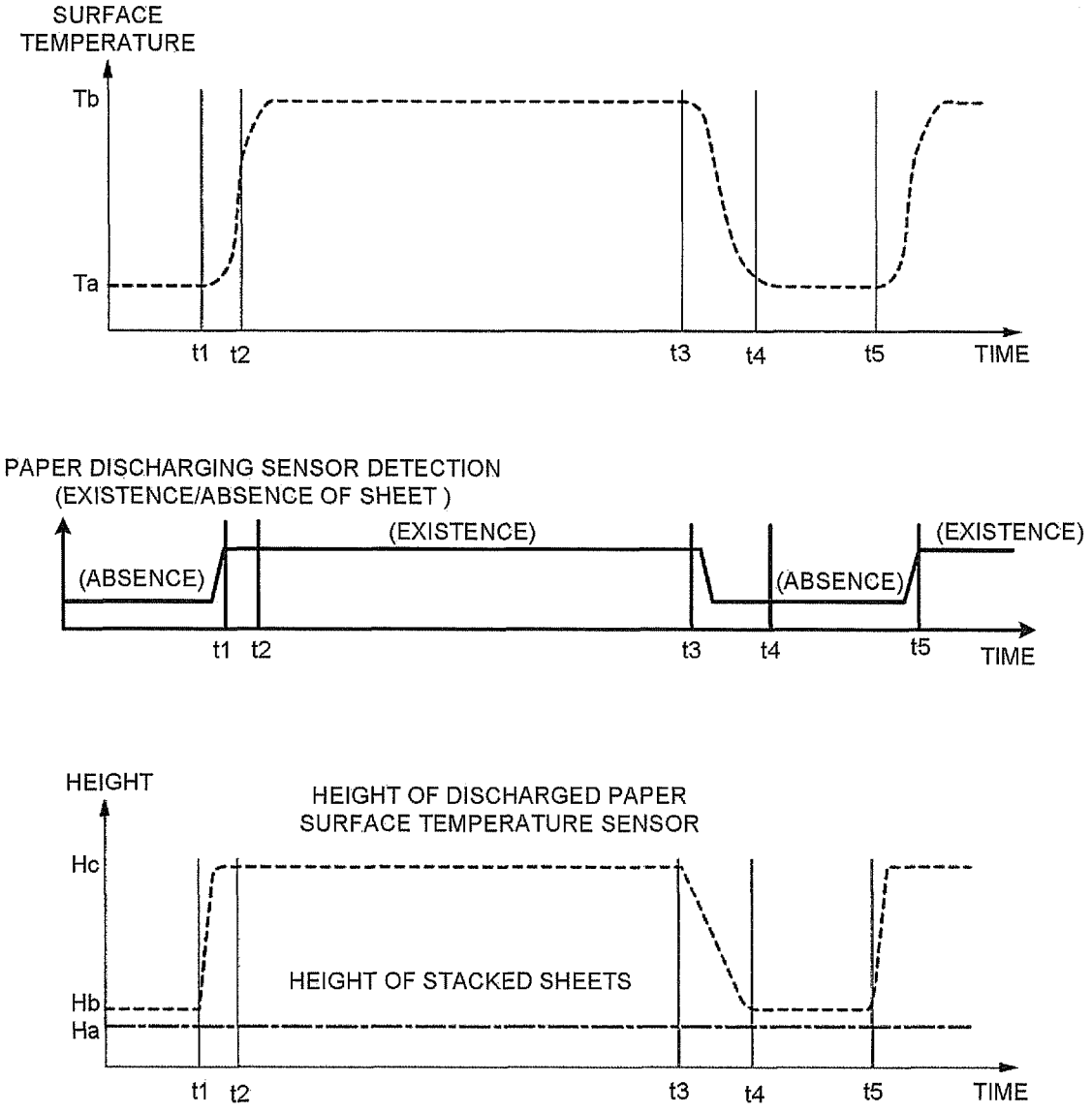
FIG. 7 is a diagram exemplifying the variation of the surface temperature of the sheets in an upper paper discharging tray of an image forming apparatus, the output of a paper discharging sensor and the heights of a discharged paper surface temperature sensor and stacked sheets according to an embodiment.
Figure 8:
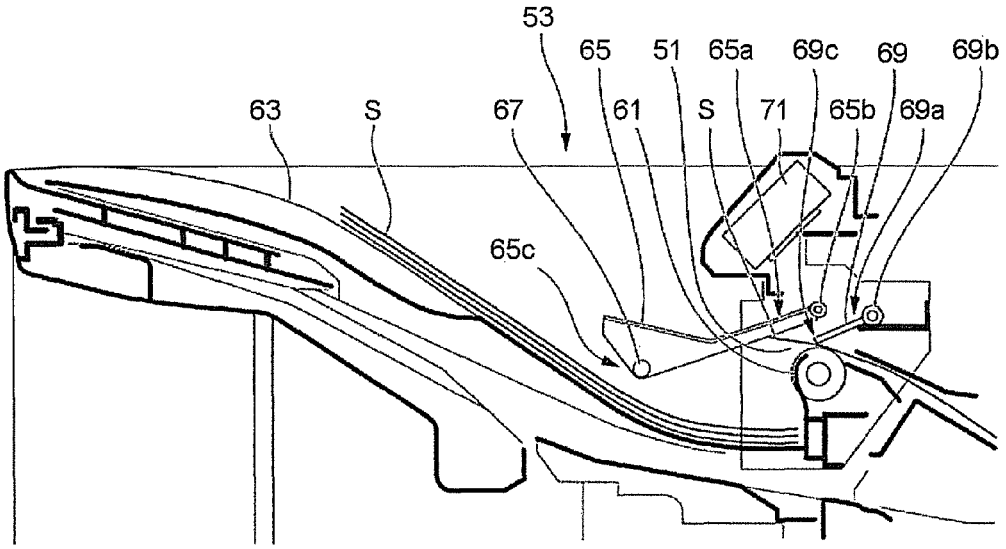
FIG. 8 is a sectional view exemplifying the state of a sheet discharged to an upper paper discharging tray of an image forming apparatus, the state of a paper discharging sensor actuator and the state of a discharged paper surface temperature sensor according to an embodiment and a diagram showing a state in which a sheet presses a second end of the paper discharging sensor actuator upward.
Figure 9:
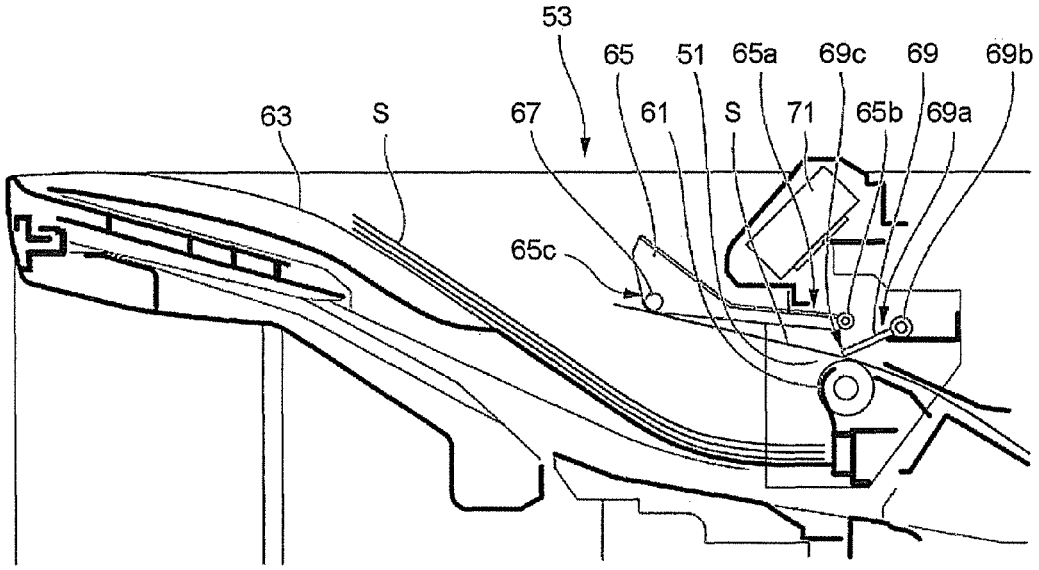
FIG. 9 is a sectional view exemplifying the state of a sheet discharged to an upper paper discharging tray of an image forming apparatus, the state of a paper discharging sensor actuator and the state of a discharged paper surface temperature sensor according to an embodiment and a diagram showing a state in which a sheet presses a second end of a stacked sheet number sensor actuator upward.
Figure 10:
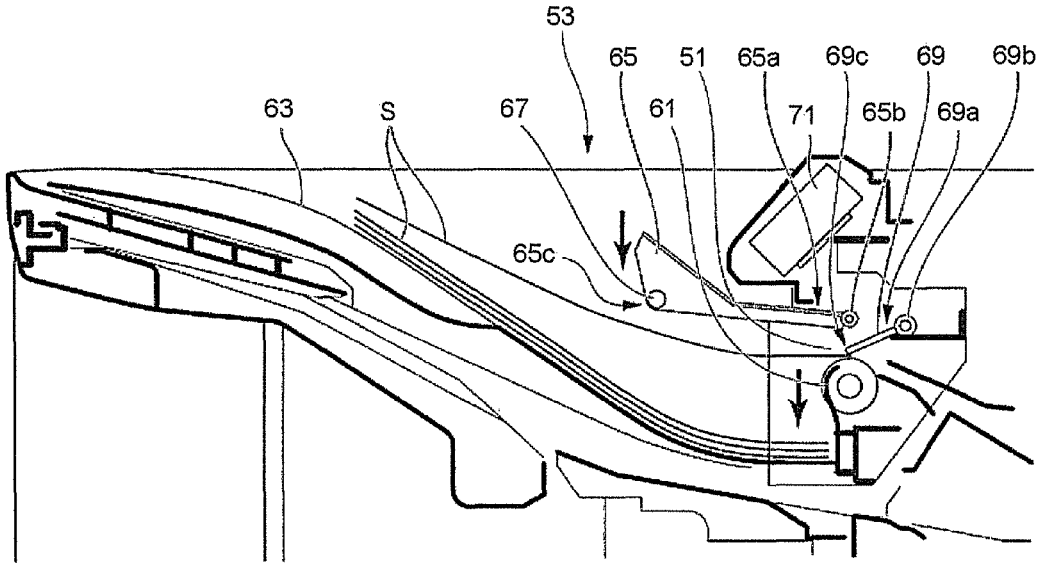
FIG. 10 is a sectional view exemplifying the state of a sheet discharged to an upper paper discharging tray of an image forming apparatus, the state of a paper discharging sensor actuator and the state of a discharged paper surface temperature sensor according to an embodiment and a diagram showing a state in which a sheet is separated from a stacked sheet number sensor actuator.
Figure 11:
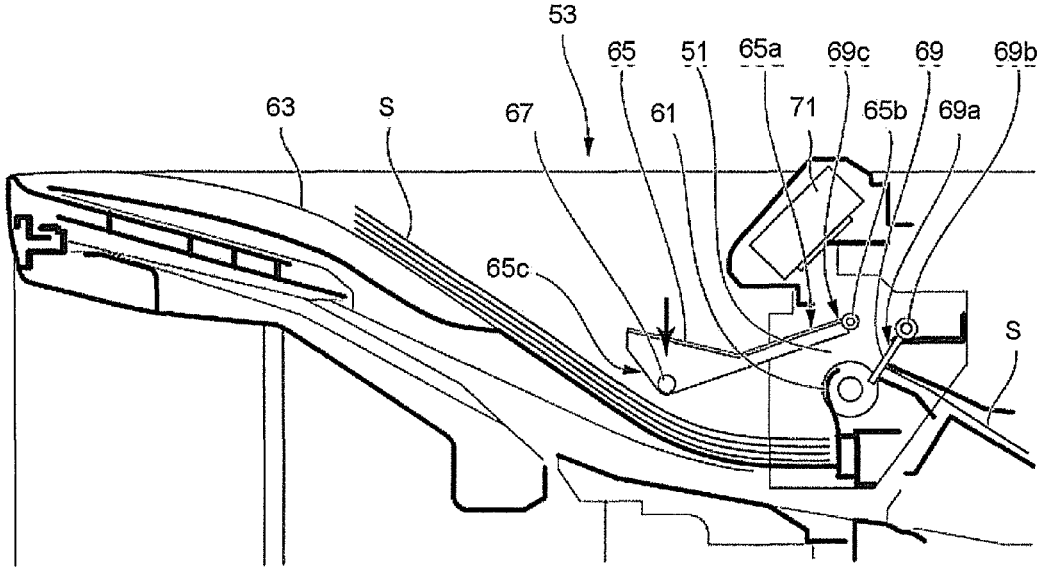
FIG. 11 is a sectional view exemplifying the state of a sheet discharged to an upper paper discharging tray of an image forming apparatus, the state of a paper discharging sensor actuator and the state of a discharged paper surface temperature sensor according to an embodiment and a diagram showing a state in which a sheet is stacked in the upper paper discharging tray.

FIG. 7 is a diagram exemplifying the variation of the surface temperature of the sheets S in the upper paper discharging tray 63, the output of the paper discharging sensor 70 and the heights of the discharged paper surface temperature sensor 67 and stacked sheets. FIG. 8 is a sectional view exemplifying the state of a sheet S discharged to the upper paper discharging tray of an image forming apparatus, the state of the paper discharging sensor actuator 69 and the state of the discharged paper surface temperature sensor 67 according to an embodiment and a diagram showing a state in which a sheet S presses the second end 69*c* of the paper discharging sensor actuator 69 upward. FIG. 9 is a sectional view exemplifying the state of a sheet S discharged to the upper paper discharging tray of an image forming apparatus, the state of the paper discharging sensor actuator 69 and the state of the discharged paper surface temperature sensor 67 according to an embodiment and a diagram showing a state in which a sheet S presses the second end 65*c* of the stacked sheet number sensor actuator upward. FIG. 10 is a sectional view exemplifying the state of a sheet S discharged to the upper paper discharging tray of an image forming apparatus, the state of the paper discharging sensor actuator 69 and the state of the discharged paper surface temperature sensor 67 according to an embodiment and a diagram showing a state in which a sheet S is separated from the stacked sheet number sensor actuator 65. FIG. 11 is a sectional view exemplifying the state of a sheet S discharged to the upper paper discharging tray of an image forming apparatus, the state of the paper discharging sensor actuator 69 and the state of the discharged paper surface temperature sensor 67 according to an embodiment and a diagram showing a state in which a sheet S is stacked in the upper paper discharging tray 63.

The paper discharging sensor 70 carries out no detection for a sheet S prior to the moment t1 shown in FIG. 7. The discharged paper surface temperature sensor 67 detects atmosphere temperature. The height Ha of the sheets S stacked in the upper paper discharging tray 63 is smaller than the height Hb of the discharged paper surface temperature sensor 67.

The sheet S which is just fixed by and discharged from the fixing section 29 is discharged from the upper paper discharging opening 51 at the moment t1 shown in FIG. 7, as shown in FIG. 8. The sheet S presses the second end 69*c* of the paper discharging sensor actuator 69 upwards. The paper discharging sensor 70 outputs an 'on' signal representing the existence of a sheet. The discharged paper cooling fan 71 supplies air for the sheet S discharged from the upper paper discharging opening 51. The temperature of the sheet S just fixed is, for example, about 80 degrees centigrade. As the sheet S from the upper paper discharging opening 51 is not contacted with the stacked sheet number sensor actuator 65, no external force is applied to the stacked sheet number sensor actuator 65. The second end 65*c* of the stacked sheet number sensor actuator 65 descends for the sake of the dead weight thereof and stops at the lowest position in an action range. A proper gap is kept between the discharged paper surface temperature sensor 67 and the sheets S stacked in the upper paper discharging tray 63. The discharged paper surface temperature sensor 67 is not contacted with the top sheet S in the upper paper discharging tray 63. The discharged paper surface temperature sensor 67 detects atmosphere temperature Ta. The atmosphere temperature Ta is, for example, about 35 degrees centigrade. As the temperature detected by the discharged paper surface temperature sensor 67 is below the specific temperature threshold, the control section 101 continues to feed a new sheet S to the printer unit 3 and continues the action of the printer unit 3.

The sheet S from the upper paper discharging opening 51 presses the stacked sheet number sensor actuator 65 upwards at the moment t2 shown in FIG. 7, as shown in FIG. 9. The sheet S pressing the stacked sheet number sensor actuator 65 upwards is contacted with the discharged paper surface temperature sensor 67. The height He of the discharged paper surface temperature sensor 67 is increased after being contacted with the sheet S when compared with the height Hb. Because of the cooling of the discharged paper cooling fan 71, the temperature of the sheet S contacted with the discharged paper surface temperature sensor 67 drops from the temperature of the sheet just fixed. The temperature of the sheet S contacted with the discharged paper surface temperature sensor 67 is, for example, about 70 degrees centigrade. If the sheet S is contacted with the discharged paper surface temperature sensor 67, then the temperature detected by the discharged paper surface temperature sensor 67 is gradually increased from the atmosphere temperature Ta to the temperature Tb of the sheet S.

The sheet S is conveyed and separated from the paper discharging sensor actuator 69 from the moment t3 to the moment t4 shown in FIG. 7, as shown in FIG. 10. The second end 69*c* of the paper discharging sensor actuator 69 is rotated downwards for the sake of the dead weight thereof. The paper discharging sensor 70 outputs an 'off' signal representing the absence of a sheet. If the rear end of the sheet S is discharged from the upper paper discharging opening 51, then the sheet S falls towards the upper paper discharging tray 63. The second end 65*c* of the stacked sheet number sensor actuator 65 descends for the sake of the dead weight thereof and stops at the lowest position in an action range. The temperature detected by the discharged paper surface temperature sensor 67 is gradually reduced from the temperature Tb of the sheet S to the atmosphere temperature Ta.

The sheet S from the upper paper discharging opening 51 is stacked in the upper paper discharging tray 63 from the moment t4 to the moment t5 shown in FIG. 7, as shown in FIG. 11. The second end 69*c* of the paper discharging sensor actuator 69 stops at the lowest position in the action range. The paper discharging sensor 70 outputs an 'off' signal representing the absence of a sheet. The second end 65*c* of the stacked sheet number sensor actuator stops at the lowest position in an action range. A proper gap is kept between the discharged paper surface temperature sensor 67 and the sheets S stacked in the upper paper discharging tray 63. The discharged paper surface temperature sensor 67 is not contacted with the top sheet S in the upper paper discharging tray 63. The discharged paper surface temperature sensor 67 detects atmosphere temperature Ta. Through the cooling of the discharged paper cooling fan 71, the temperature of the sheets S stacked in the upper paper discharging tray 63 is gradually reduced.

The sheet S which is just fixed by the fixing section 29 is discharged from the upper paper discharging opening 51 at the moment t5 shown in FIG. 7, as shown in FIG. 8. The sheet S presses the second end 69*c* of the paper discharging sensor actuator 69 upwards. The paper discharging sensor 70 outputs an 'on' signal representing the existence of a sheet. A proper gap is kept between the discharged paper surface temperature sensor 67 and the sheets S stacked in the upper paper discharging tray 63. The discharged paper surface temperature sensor 67 is not contacted with the top sheet S in the upper paper discharging tray 63. The discharged paper surface temperature sensor 67 detects atmosphere temperature Ta. The atmosphere temperature is, for example, about 35 degrees centigrade. As the temperature detected by the discharged paper surface temperature sensor 67 is below the specific temperature threshold, the control section 101 continues to feed a new sheet S to the printer unit 3 and continues the action of the printer unit 3.

The actions carried out by the image forming apparatus 100 in a case where a great number of sheets S are stacked in the upper paper discharging tray 63 and the discharged paper surface temperature sensor 67 is contacted with a sheet S.

Figure 12:
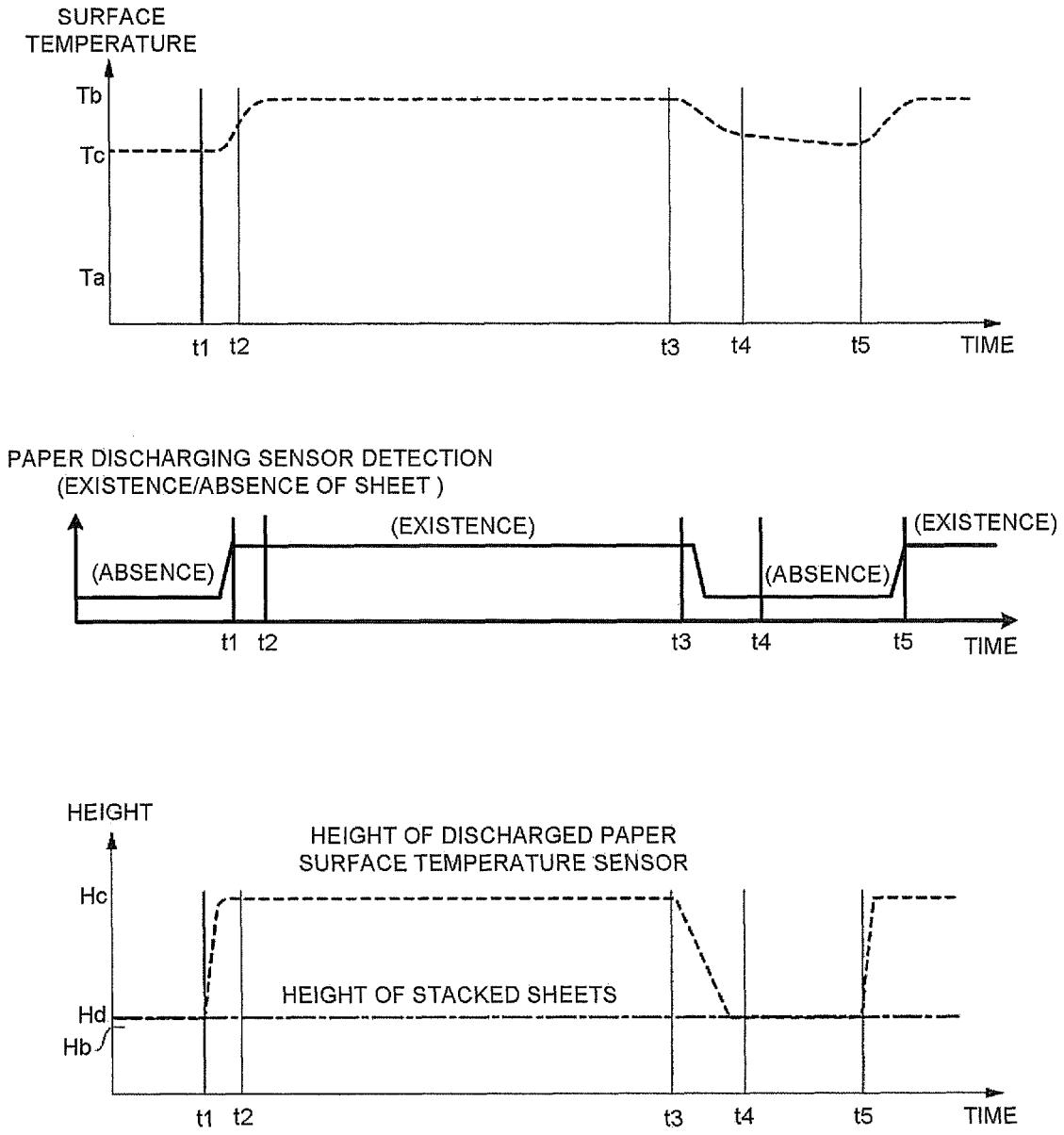
FIG. 12 is a diagram exemplifying the variation of the surface temperature of the sheets in an upper paper discharging tray of an image forming apparatus, the output of a paper discharging sensor and the heights of a discharged paper surface temperature sensor and stacked sheets according to an embodiment.
Figure 13:
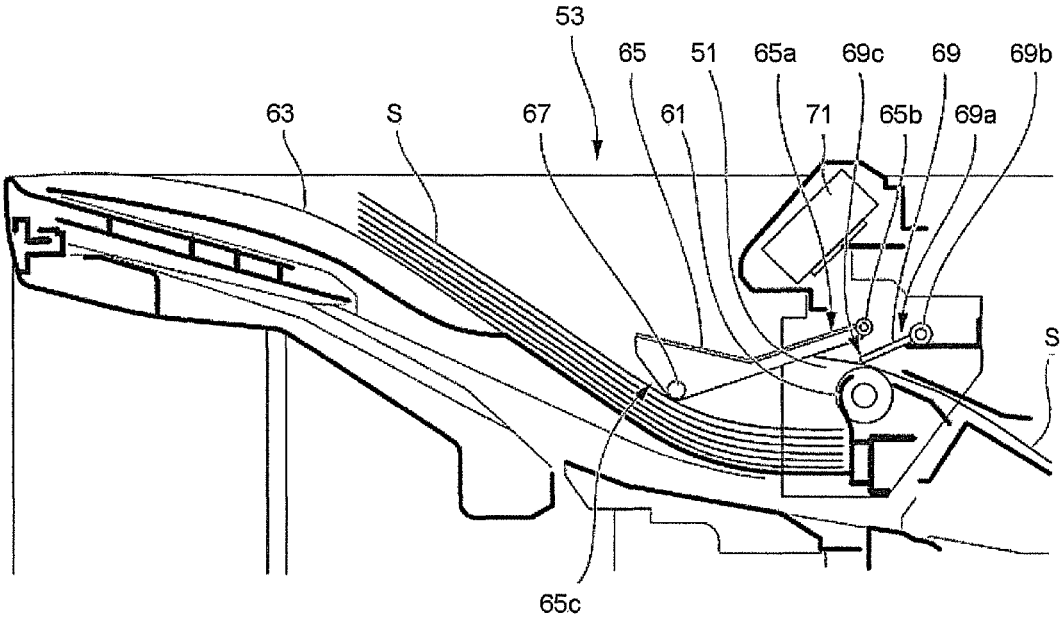
FIG. 13 is a sectional view exemplifying the state of a sheet discharged to an upper paper discharging tray of an image forming apparatus, the state of a paper discharging sensor actuator and the state of a discharged paper surface temperature sensor according to an embodiment and a diagram showing a state in which a sheet presses a second end of the paper discharging sensor actuator upward.
Figure 14:
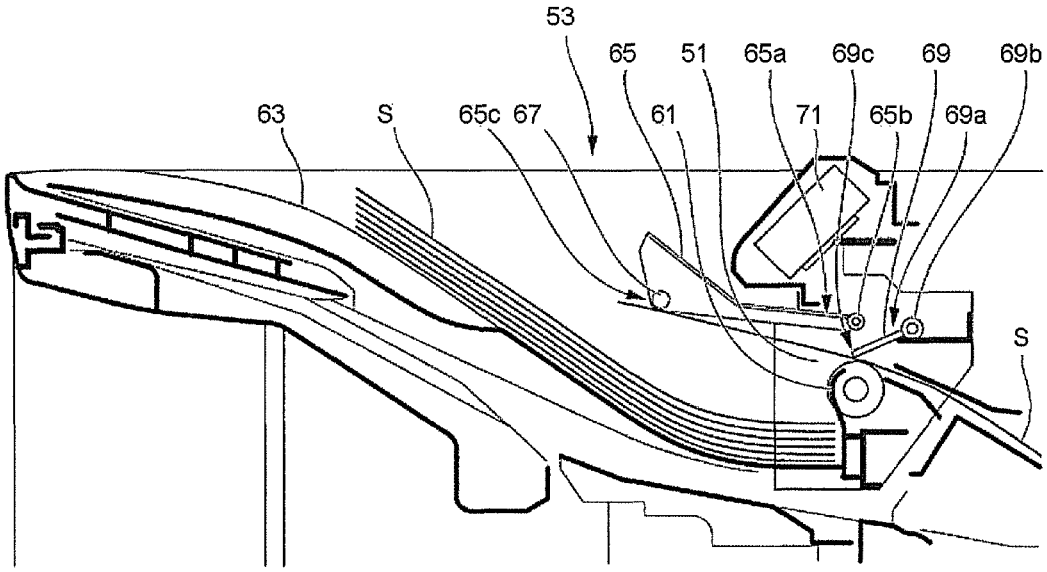
FIG. 14 is a sectional view exemplifying the state of a sheet discharged to an upper paper discharging tray of an image forming apparatus, the state of a paper discharging sensor actuator and the state of a discharged paper surface temperature sensor according to an embodiment and a diagram showing a state in which a sheet presses a second end of a stacked sheet number sensor actuator upward.
Figure 15:
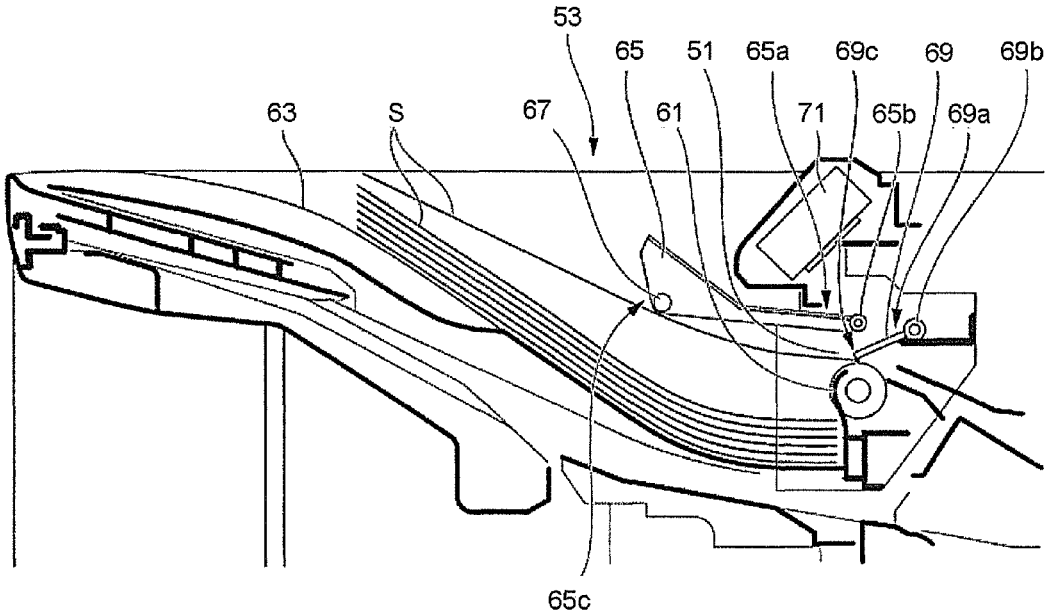
FIG. 15 is a sectional view exemplifying the state of a sheet discharged to an upper paper discharging tray of an image forming apparatus, the state of a paper discharging sensor actuator and the state of a discharged paper surface temperature sensor according to an embodiment and a diagram showing a state in which a sheet is to be separated from the paper discharging sensor actuator.
Figure 16:
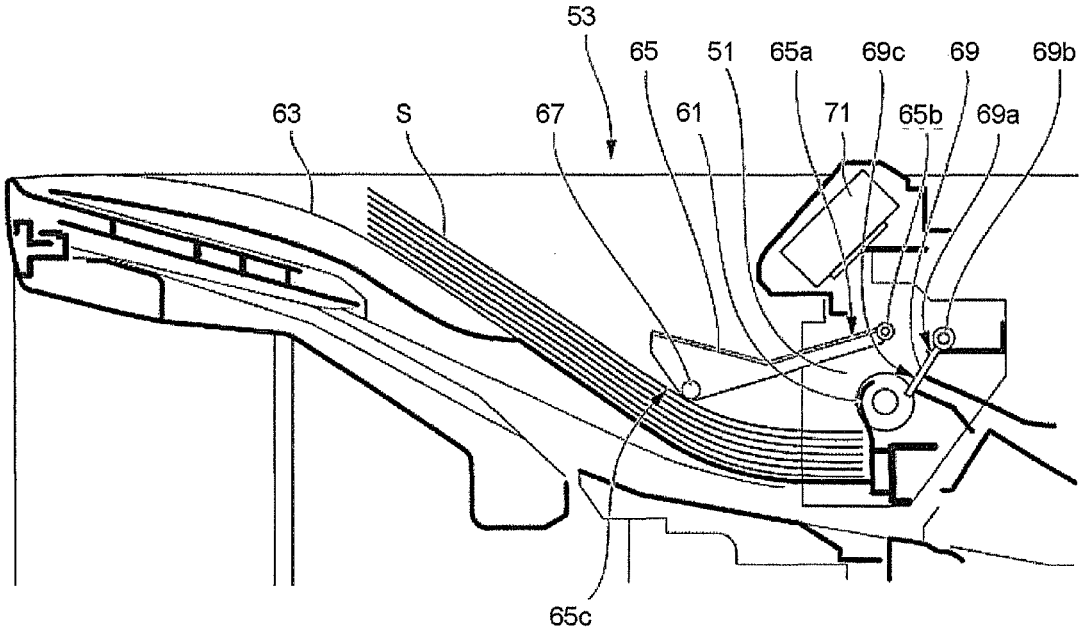
FIG. 16 is a sectional view exemplifying the state of a sheet discharged to an upper paper discharging tray of an image forming apparatus, the state of a paper discharging sensor actuator and the state of a discharged paper surface temperature sensor according to an embodiment and a diagram showing a state in which a sheet is stacked in the upper paper discharging tray.

FIG. 12 is a diagram exemplifying the variation of the surface temperature of the sheets in the upper paper discharging tray 63, the output of the paper discharging sensor 70 and the heights of the discharged paper surface temperature sensor 67 and stacked sheets S. FIG. 13 is a sectional view exemplifying the state of a sheet S discharged to the upper paper discharging tray of an image forming apparatus, the state of the paper discharging sensor actuator 69 and the state of the discharged paper surface temperature sensor 67 according to an embodiment and a diagram showing a state in which a sheet S presses the second end 69*c* of the paper discharging sensor actuator 69 upward. FIG. 14 is a sectional view exemplifying the state of a sheet S discharged to the upper paper discharging tray of an image forming apparatus, the state of the paper discharging sensor actuator 69 and the state of the discharged paper surface temperature sensor 67 according to an embodiment and a diagram showing a state in which a sheet S presses the second end 65*c* of the stacked sheet number sensor actuator upward. FIG. 15 is a sectional view exemplifying the state of a sheet S discharged to the upper paper discharging tray of an image forming apparatus, the state of the paper discharging sensor actuator 69 and the state of the discharged paper surface temperature sensor 67 according to an embodiment and a diagram showing a state in which a sheet S is to be separated from the paper discharging sensor actuator 69. FIG. 16 is a sectional view exemplifying the state of a sheet S discharged to the upper paper discharging tray of an image forming apparatus, the state of the paper discharging sensor actuator 69 and the state of the discharged paper surface temperature sensor 67 according to an embodiment and a diagram showing a state in which a sheet S is stacked in the upper paper discharging tray 63.

The paper discharging sensor 70 carries out no detection for a sheet S prior to the moment t1 shown in FIG. 12. The height Hd of sheets S stacked in the upper paper discharging tray 63 is higher than the lowest position of the second end 65*c* of the stacked sheet number sensor actuator 65. The second end 65*c* of the stacked sheet number sensor actuator 65 is lifted upwards by the sheet S in the upper paper discharging tray 63. For the upper paper discharging tray 63, the height Hd of the discharged paper surface temperature sensor 67 is equal to the height Hd of the stacked sheets S. The discharged paper surface temperature sensor 67 is contacted with the top sheet S in the upper paper discharging tray 63. The discharged paper surface temperature sensor 67 detects the surface temperature Tc of the top sheet S in the upper paper discharging tray 63. The surface temperature of the top sheet S in the upper paper discharging tray 63 is gradually reduced through natural heat dissipation. The surface temperature of the sheet S detected by the discharged paper surface temperature sensor 67 is higher than the atmosphere temperature Ta. The surface temperature of the sheets S is, for example, about 59 degrees centigrade.

The sheet S which is just fixed by the fixing section 29 is discharged from the upper paper discharging opening 51 at the moment t1 shown in FIG. 12, as shown in FIG. 13. The sheet S presses the second end 69*c* of the paper discharging sensor actuator 69 upwards. The paper discharging sensor 70 outputs an 'on' signal representing the existence of a sheet. The discharged paper cooling fan 71 supplies air for the sheet S discharged from the upper paper discharging opening 51. The temperature of the sheet S just fixed is, for example, about 80 degrees centigrade. The sheet S from the upper paper discharging opening 51 is not contacted with the stacked sheet number sensor actuator 65. The discharged paper surface temperature sensor 67 detects the surface temperature of the top sheet S in the upper paper discharging tray 63. As the temperature detected by the discharged paper surface temperature sensor 67 is below the specific temperature threshold, the control section 101 continues to feed a new sheet S to the printer unit 3 and continues the action of the printer unit 3.

The sheet S from the upper paper discharging opening 51 presses the stacked sheet number sensor actuator 65 upwards at the moment t2 shown in FIG. 12, as shown in FIG. 14. The sheet S pressing the stacked sheet number sensor actuator 65 upwards is contacted with the discharged paper surface temperature sensor 67. The height He of the discharged paper surface temperature sensor 67 is increased after being contacted with the sheet S. Through the cooling of the discharged paper cooling fan 71, the temperature of the sheet S contacted with the discharged paper surface temperature sensor 67 drops from the temperature of the sheet S just fixed. The temperature of the sheet S contacted with the discharged paper surface temperature sensor 67 is, for example, about 70 degrees centigrade. The temperature detected by the discharged paper surface temperature sensor 67 is gradually increased from the surface temperature of the sheets S in the upper paper discharging tray 63 to the temperature Tb of the sheet S from the upper paper discharging opening 51.

The sheet S is conveyed and separated from the paper discharging sensor actuator 69 from the moment t3 to the moment t4 shown in FIG. 12, as shown in FIG. 15. The second end 69*c* of the paper discharging sensor actuator 69 is rotated downwards for the sake of the dead weight thereof. The paper discharging sensor 70 outputs an 'off' signal representing the absence of a sheet. After the rear end of a sheet S is discharged from the upper paper discharging opening 51, then the sheet S falls towards the upper paper discharging tray 63. The second end 65*c* of the stacked sheet number sensor actuator 65 stops at the lowest position in an action range for the sake of the dead weight thereof. Cooled by the discharged paper cooling fan 71 for the sheet S discharged from the upper paper discharging opening 51, the temperature detected by the discharged paper surface temperature sensor 67 is gradually reduced from the temperature Tb.

The sheet S from the upper paper discharging opening 51 is stacked in the upper paper discharging tray 63 from the moment t4 to the moment t5 shown in FIG. 12, as shown in FIG. 16. The paper discharging sensor 70 outputs an 'off' signal representing the absence of a sheet. Before stopping at the lowest position in an action range, the second end 69*c* of the paper discharging sensor actuator 69 stops at the height Hd of the sheets stacked in the upper paper discharging tray 63. For the upper paper discharging tray 63, the height Hd of the discharged paper surface temperature sensor 67 is equal to the height Hd of the stacked sheets S. The discharged paper surface temperature sensor 67 is contacted with the top sheet S in the upper paper discharging tray 63. The discharged paper surface temperature sensor 67 detects the surface temperature of the top sheet S in the upper paper discharging tray 63. The surface temperature of the top sheet S in the upper paper discharging tray 63 is gradually reduced through the cooling of the discharged paper cooling fan 71.

The sheet S which is just fixed by the fixing section 29 is discharged from the upper paper discharging opening 51 at the moment t5 shown in FIG. 12, as shown in FIG. 13. The sheet S presses the second end 69*c* of the paper discharging sensor actuator 69 upwards. The paper discharging sensor 70 outputs an 'on' signal representing the existence of a sheet. The discharged paper surface temperature sensor 67 is contacted with the top sheet S in the upper paper discharging tray 63. The discharged paper surface temperature sensor 67 detects the surface temperature of the top sheet S in the upper paper discharging tray 63. Because of the heat of the newly stacked sheet S, the surface temperature of the sheet S is higher than the surface temperature presented at the moment t1. The surface temperature of the sheets S is, for example, about 61 degrees centigrade. As the temperature detected by the discharged paper surface temperature sensor 67 is above the specific temperature threshold, the control section 101 determines whether or not color printing is specified in the print job. If color printing is specified in the print job, the control section 101 stops the feed of a new sheet S to the printer unit 3 and the new printing operation of the printer unit 3. If color printing is not specified in the print job, the control section 101 determines whether or not the print density included in the print condition for the print job is above the specific print density. If the print density included in the print condition for the print job is above the specific print density, the control section 101 stops the feed of a new sheet S to the printer unit 3 and the new printing operation of the printer unit 3.

Provided with the control section 101 capable of determining whether or not to implement a new printing action and feed a new sheet, the image forming apparatus 100 described in the foregoing embodiments is capable of properly preventing the occurrence of sticking. The control section 101 determines whether or not to implement a new printing action and feed a new sheet according to the surface temperature of stacked sheets S, thus preventing a printing action and the feed of a sheet from being interrupted because the surface temperature is below a temperature threshold. The control section 101 determines whether or not to implement a new print action and feed a sheet according to the content of the print job, thus preventing the occurrence of sticking from being unpredictable and the print job from being interrupted. A new print job and the feed of a new sheet can be properly interrupted after the occurrence of sticking is predicted during a print job. In double-side printing involving the contact of toners of stacked sheets S, the occurrence of sticking can be prevented in the case of a color printing realized by overlapping toners of a plurality of toners or in a case where the print density is above a specific print density.

Because of the control section 101 which is capable of determining, for each sheet S, whether or not to implement a new print action and whether or not to feed the sheet S, the occurrence of sticking can be properly prevented. Even if heat is increased because of a newly stacked sheet S and heat dissipation is deteriorated as more sheets are stacked, the surface temperature of the sheets S is still below the temperature threshold. As the control section 101 can continue the current print action, the printing interruption caused by an inappropriate condition is avoided.

Because of the discharged paper surface temperature sensor 67 which detects the surface temperature of stacked sheets S every time the discharging of a sheet S is stacked, temperature can be detected at proper time.

Because of the discharged paper surface temperature sensor 67 arranged on existing stacked sheet number sensor actuator 65, the apparatus is reduced in cost and simplified in structure.

Because of the control section 101 which releases an interrupted state when the surface temperature of the sheets S is below the temperature threshold after the implementation of a new print action and the feed of a sheet are interrupted, the interruption can be prevented from being surplus.

Variations of the foregoing embodiments are described below.

In the foregoing embodiments, the printer unit 3 implements double-side printing with the image data generated by the scanner unit 2, however, the present invention is not limited to this.

In a variation of the present invention, the printer unit 3 may implement double-side printing with the image data received from another information processing apparatus via a network.

In the image forming apparatus 100 of the foregoing embodiment, the discharged paper surface temperature sensor 67 is a contact type temperature sensor; however, the present invention is not limited to this.

In an image forming apparatus 100 involved in a variation of the foregoing embodiment, the discharged paper surface temperature sensor 67 may be a non-contact type temperature sensor.

In accordance with at least one of the foregoing embodiments, the control section 101 is capable of determining whether or not to implement a new printing action and the feed of a new sheet, thus preventing the occurrence of sticking properly. As the control section 101 is capable of determining whether or not to implement a new printing action and the feed of a new sheet according to the surface temperature of stacked sheets S, the interruption of a printing action and the feed of a new sheet occurring when the surface temperature is below a temperature threshold is prevented. The control section 101 determines whether or not to implement a new print action and the feed of a new sheet according to the content of a print job, thus preventing the occurrence of sticking from being unpredictable and the print job from being interrupted.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a paper feeding unit configured to feed a sheet-shaped recording medium;

an image forming unit configured to form a toner image on the recording medium fed from the paper feeding unit;

a fixing unit configured to fix the toner image formed by the image forming unit on the recording medium;

a stacking unit configured to stack the recording medium on which the toner image is fixed by the fixing unit;

a temperature sensor configured to detect the surface temperature of the recording mediums stacked on the stacking unit;

a stacked sheet number sensor actuator which moves up and down according to a number of the recording mediums stacked on the stacking unit; and a control unit configured to make a determination, according to a printing information of the recording medium, not to feed a new recording medium from the paper feeding unit when the surface temperature of the recording mediums detected by the temperature sensor is above a threshold temperature in a case where the number of the recording mediums stacked on the stacking unit and detected by the stacked sheet number sensor actuator is equal to or greater than a predetermined number, wherein when the control unit makes the determination, the control unit prints on a recording medium following the recording mediums of which the surface temperature is detected by the temperature sensor where the recording medium has already fed from the paper feeding unit before the control unit makes the determination, and the control unit conveys the printed recording medium to the stacking unit.

2. The image forming apparatus according to claim 1, wherein the temperature sensor detects the surface temperature of the recording mediums already stacked on the stacking unit when the recording medium on which the toner image is fixed by the fixing unit is discharged to the stacking unit.

3. The image forming apparatus according to claim 1, wherein after stopping the feed of the new recording medium from the paper feeding unit, the control unit releases the interruption of the feed of the new recording medium from the paper feeding unit when the surface temperature of the recording mediums detected by the temperature sensor is below the threshold temperature.

4. The image forming apparatus according to claim 1, wherein the temperature sensor detects the surface temperature of the recording mediums stacked on the stacking unit only in the case where the number of the recording mediums stacked on the stacking unit is equal to or greater than the predetermined number.

5. The image forming apparatus according to claim 1, wherein the predetermined number is a number of the recording mediums at which the recording mediums are stackable without a sticking of the toner image.

6. An image forming method, comprising:

feeding a sheet-shaped recording medium from a paper feeding unit;

forming a toner image on the recording medium using an image forming unit;

fixing, using a fixing unit, the toner image formed by the image forming unit on the recording medium;

stacking, using a stacking unit, the recording medium on which the toner image is fixed by the fixing unit;

detecting, using a temperature sensor, the surface temperature of the recording mediums stacked on the stacking unit;

detecting, using a stacked sheet number sensor actuator which moves up and down according to a number of the recording mediums stacked on the stacking unit, the number of the recording mediums stacked on the stacking unit;

making a determination, using a control unit, not to feed a new recording medium from the paper feeding unit according to a printing information of the recording medium when the surface temperature of the recording mediums detected by the temperature sensor is above a threshold temperature in a case where the number of the recording mediums stacked on the stacking unit and detected by the stacked sheet number sensor actuator is equal to or greater than a predetermined number, and when the control unit makes the determination, printing on a recording medium following the recording mediums of which the surface temperature is detected by the temperature sensor where the recording medium has already fed from the paper feeding unit before the control unit makes the determination, and conveying the printed recording medium to the stacking unit.

7. The image forming method according to claim 6, comprising:

detecting, using the temperature sensor, the surface temperature of the recording medium already stacked on the stacking unit when the recording medium on which the toner image is fixed by the fixing unit is discharged to the stacking unit.

8. The image forming method according to claim 6, comprising:

releasing, using the control unit, the interruption of the feed of the new recording medium from the paper feeding unit when the surface temperature of the recording mediums detected by the temperature sensor is below the threshold temperature after the feed of the new recording medium from the paper feeding unit is stopped.

9. The image forming method according to claim 6, comprising:

detecting, using a temperature sensor, the surface temperature of the recording mediums stacked on the stacking unit only in the case where the number of the recording mediums stacked on the stacking unit is equal to or greater than the predetermined number.

10. The image forming method according to claim 6, wherein the predetermined number is a number of the recording mediums at which the recording mediums are stackable without a sticking of the toner image.

* * * * *